US008170441B2

(12) United States Patent
Ferrar et al.

(10) Patent No.: US 8,170,441 B2
(45) Date of Patent: May 1, 2012

(54) CLEANING BLADE FOR ELECTROSTATOGRAPHIC APPARATUS

(75) Inventors: Wayne T. Ferrar, Fairport, NY (US); Donald S. Rimai, Webster, NY (US); Edward T. Miskinis, Rochester, NY (US); M. Cristina B. Dejesus, Basking Ridge, NJ (US)

(73) Assignee: Eastman Kodak Company, Rochester, NY (US)

( * ) Notice: Subject to any disclaimer, the term of this patent is extended or adjusted under 35 U.S.C. 154(b) by 175 days.

(21) Appl. No.: 12/713,205

(22) Filed: Feb. 26, 2010

(65) Prior Publication Data

US 2011/0211883 A1 Sep. 1, 2011

(51) Int. Cl.
*G03G 15/16* (2006.01)
*G03G 21/00* (2006.01)

(52) U.S. Cl. ..... 399/101; 399/350

(58) Field of Classification Search ..... 399/101, 399/350, 351

See application file for complete search history.

(56) References Cited

U.S. PATENT DOCUMENTS 5,153,657 A * 10/1992 Yu et al. ..... 399/350
5,363,182 A 11/1994 Kuribayashi et al.
5,968,656 A 10/1999 Ezenyilimba et al.
6,238,798 B1 5/2001 Kang et al.
6,453,134 B1 9/2002 Ziegelmuller et al.
7,120,380 B2 10/2006 Ferrar et al.
8,068,779 B2 * 11/2011 Fowler et al. ..... 399/350
2006/0165974 A1 7/2006 Ferrar et al.
2007/0196151 A1 8/2007 Ferrar et al.
2007/0244289 A1 10/2007 Audenaert et al.
2008/0107463 A1 5/2008 Ferrar et al.
2009/0052964 A1 2/2009 Ferrar et al.

OTHER PUBLICATIONS

Kuniki Seino, et al., "Wear Characteristics and Cleaning Ability of Cleaning Blades," Journal of Imaging Science and Technology, vol. 47, No. 5, Sep./Oct. 2003, p. 424-433.

* cited by examiner

*Primary Examiner* — Hoang Ngo
(74) *Attorney, Agent, or Firm* — Andrew J. Anderson

(57) ABSTRACT

A cleaning blade member including a polymer substrate and a fluorinated polyurethane ceramer coating surface layer. The polymer substrate may comprise polyurethane. The fluorinated polyurethane ceramer coating may comprise a fluorinated polyurethane silicate hybrid organic-inorganic network formed as a reaction product of a fluorinated polyurethane having terminal reactive alkoxysilane groups with a tetraalkoxysilane compound. The fluorinated polyurethane ceramer coating may be coated on the polymer substrate of the cleaning blade without any primer layer therebetween. Also described is an electrostatographic apparatus comprising a toner-contacting member and such a fluorinated ceramer coated cleaning blade for the toner-contacting member. The toner-contacting member may comprise an endless transport web. The fluorinated ceramer enhances the ability of particles to be released from the surface therefore reducing contamination generated due to particles attached to the surface. Coating of a cleaning blade made of polyurethane with such fluorinated ceramer resulted in improved cleaning performance.

16 Claims, 4 Drawing Sheets

CLEANING BLADE FOR ELECTROSTATOGRAPHIC APPARATUS

FIELD OF THE INVENTION

This invention relates to cleaning blades of the type used, for example, in electrostatographic apparatus to remove residual toner, carrier, dust, lint, paper fibers, and like from a moving surface, typically in the form of an endless web or drum, and more particularly, to a cleaning blade having a low surface energy fluorinated ceramer coating.

BACKGROUND OF THE INVENTION

Blade cleaning is a widely practiced technique in electrostatographic printers and copiers for removal of toner particles from surfaces (K. Seino, S. Yuge, M. Uemura; Journal of Imaging Science and Technology, 2003, Volume 47, 424). The part of the blade that contacts the surface to be cleaned is commonly a polyurethane. Urethanes are tough materials with a high degree of resilience that are well suited for making contact with a smooth surface.

The application of cleaning blades to web cleaning is reported in U.S. Pat. No. 6,453,134, the disclosure of which is incorporated by reference herein in its entirety. The web can be used as a transport element to carry a receiver through an electrophotographic printer and at the same time be used as a print substrate for process control. Toner patches are removed from the transport element after image density is measured with some type of radiation such as light emitting diodes (LEDs). The substrate to be cleaned is often a clear, insulating plastic such as poly(ethylene terephthalate) (PET). The cleaning blade typically includes a rigid stiffening plate supporting a flexible urethane rubber blade member. Preferred specifications for the urethane to obtain effective cleaning include a hardness of between 60 to 85 Shore A, an initial modulus between 500 and 1500 psi, a Bayshore resiliency above 30%, and a compression set lower than 25%.

The properties of urethane blades can be improved by surface coating over the urethane. U.S. Pat. No. 5,363,182, e.g., describes a blade body of urethane rubber and a surface coating of graphite particles in a nylon resin. A primer layer is used to enhance the adhesion of the filled nylon layer to the urethane blade. The coating serves to protect the urethane from degradation due to hydrolysis. The hydrolysis rate is often enhanced by the corona products produced by the chargers in the electrophotographic printer. The coating also has a low coefficient of friction and does not change the elasticity of the blade.

Urethane overcoats that are designed to be hard like a ceramic yet flexible like a polymer are part of a group of materials known as ceramers. As discussed in U.S. Pat. No. 5,968,656, ceramer overcoats are coated as layers of approximately 5 microns on relatively thick, resilient urethane base cushion "blanket" cylinders to provide transfer of toner from a photoreceptor to a receiver in electrophotographic printers. A preferred composition for the ceramers is of a urethane backbone made from isophoronone diisocyanate and a polyether diol. The backbone is branched by the addition of trimethylolpropane and 1,4-butane diol serves as a chain extender. The branched urethane is endcapped with 3-isocyanatopropyltriethoxysilane to provide alkoxysilane groups that can react with alkoxysilanes in a sol-gel reaction to form a polyurethane silicate hybrid organic-inorganic composite network (OIC) ceramer.

Urethane polymers containing fluorinated substituents are well known. One mode of introduction of the fluorinated component is from a fluoroether, either as an endcapper or from the diol into the polyurethane backbone. These materials are useful in a number of commercial applications.

US 2007/0244289 describes a method of making urethane based fluorinated monomers which can be used to prepare radiation curable coating compositions, and discloses that such monomers can be used to formulate a ceramer composition such as disclosed in U.S. Pat. No. 6,238,798. U.S. Pat. No. 6,238,798 describes ceramer coating compositions comprising colloidal inorganic oxide particles and a free-radically curable binder precursor which comprises a fluorochemical component that further comprises at least two free-radically curable moieties and at least one fluorinated moiety. In such compositions, the colloidal inorganic oxide particles can be surface treated with a fluoro/silane component which comprises at least one hydrolysable silane moiety and at least one fluorinated moiety. As discussed therein, aggregation of the inorganic oxide particles in such compositions can result in precipitation of such particles or gellation of the ceramer composition, which, in turn, results in a dramatic, undesirable increase in viscosity.

U.S. Pat. No. 7,120,380 describes pseudo-boehmite as an oil absorbing layer that employs fluorinated surfactants as cleaning aids for an endless receiver transport belt coating in an electrophotographic printer. Pseudo-boehmite is disclosed as in a transport member for an electrophotographic apparatus that displays high friction in US 2006/0165974. Pseudo-boehmite is disclosed as an oil absorbing layer that employs wax overcoats as cleaning aids in US 2007/0196151. Gamma-alumina is disclosed as an oil absorbing layer that employs siloxane surfactants as cleaning aids in US 2008/0107463. Gamma-alumina is disclosed as an oil absorbing layer that employs fluoro surfactants as cleaning aids in US 2009/0052964. The disclosures of all five of these patents and published applications are hereby incorporated by reference in their entireties.

SUMMARY OF THE INVENTION

It would be desirable to provide a low surface energy coating with relatively high modulus for use as a coating on polymer and in particular on polyurethane cleaning blades. There is also a need for surface coatings of polyurethane blades that do not need primer layers and still have effective adhesion to the blade surface, and which are formed from coating compositions that are not prone to aggregation of particulate material.

In accordance with one embodiment, the invention is thus directed towards a cleaning blade member comprising a polymer substrate and a fluorinated polyurethane ceramer coating surface layer. In a particular embodiment, the polymer substrate comprises polyurethane. In a further particular embodiment, the fluorinated polyurethane ceramer coating comprises a fluorinated polyurethane silicate hybrid organic-inorganic network formed as a reaction product of a fluorinated polyurethane having terminal reactive alkoxysilane groups with a tetraalkoxysilane compound. In a further particular embodiment, the fluorinated polyurethane ceramer coating is coated on the polymer substrate of the cleaning blade without any primer layer therebetween.

In a further aspect, the invention is directed towards an electrostatographic apparatus comprising a toner-contacting member and a cleaning blade for the toner-contacting member, wherein the cleaning blade comprises a polymer substrate and a ceramer coating surface layer. In a particular embodiment, the toner-contacting member comprises an endless transport web. The fluorinated-containing ceramer will enhance the ability of particles to be released from the surface therefore reducing contamination generated due to particles attached to the surface. Coating of a cleaning blade made of polyurethane resulted in improved cleaning performance.

In certain embodiments, the invention provides a polyurethane cleaning blade having an increased modulus of the surface of the blade with a low surface energy coating. This is not the same as making the polyurethane rubber thicker to increase the stiffness of the blade, which makes the blade more rigid but does not increase the surface toughness of the urethane. The ceramer coating can extend the life of the blade by preventing damage that may occur when a blade is used to clean a flexible web or drum, and increase the blade stiffness as well. Defects or damage to the web can cause the blade to tear or wear excessively in a single spot. The high modulus helps lessen damage to the blade that is common when the urethane blade is used to remove toner from a hard, rough surface. This is especially true for the cleaning of web having a release oil-absorbing porous layer comprising alumina particles held in a binder coated on a flexible web substrate used to transport receiver or paper, with the additional application as the substrate for process control of an electrophotographic printer as described in US 2008/0107463A1 and all others cited therein.

DETAILED DESCRIPTION OF THE INVENTION

Although the cleaning blade and apparatus of the invention are particularly well adapted for use in an electrostatic printing machine to clean marking particles (toner) and other particulate material from an endless web used to transport image-receiver sheets, it will be evident from the ensuing description that it is equally well suited for use in a wide variety of devices to clean particulate material from different types of moving surfaces, and in particular including other toner-contacting members of an electrostatographic apparatus such as a photoconductive imaging cylinder or belt, or an intermediate image-transfer cylinder or belt.

Figure 1:
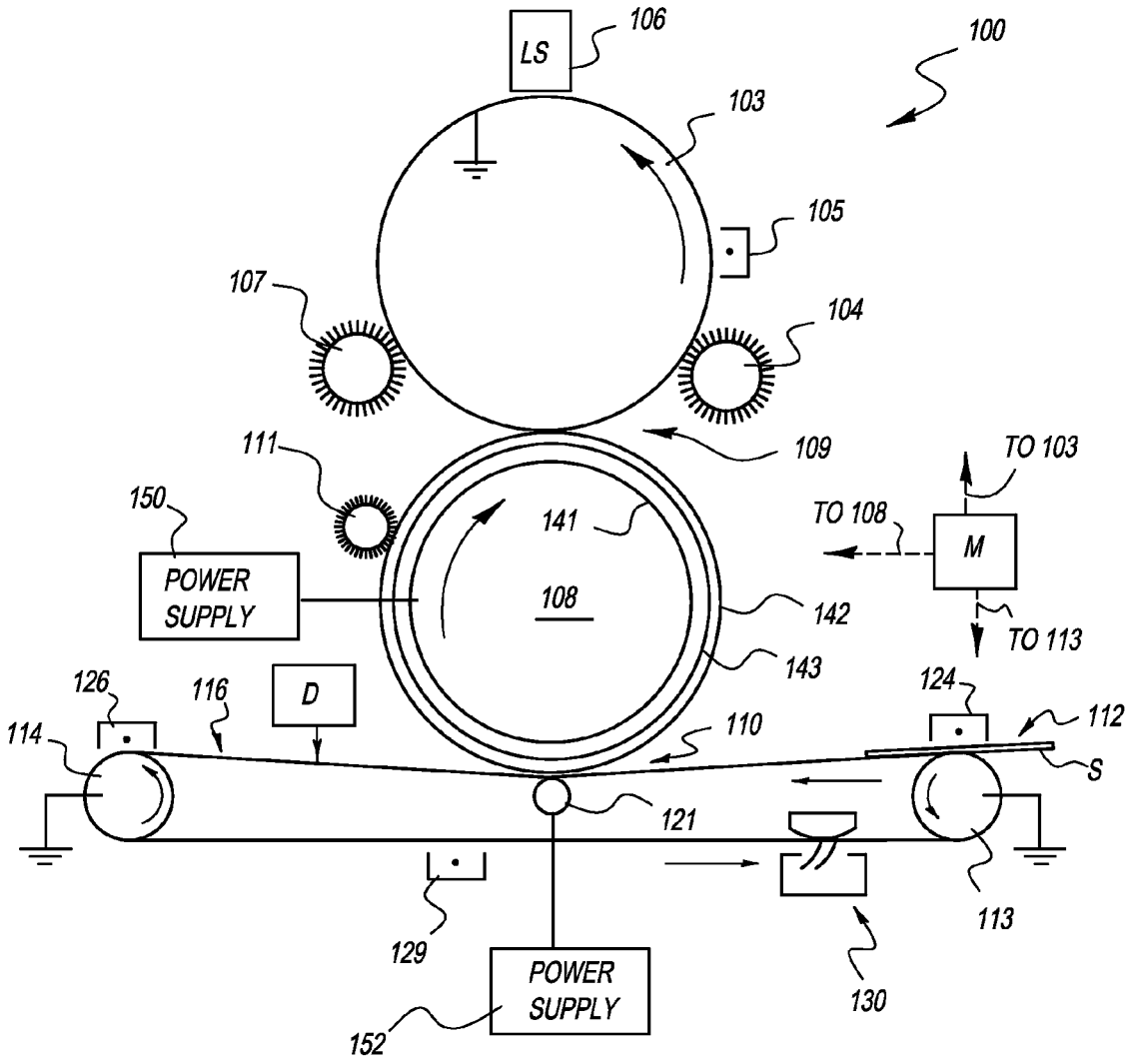
FIG. 1 is a schematic illustration of an electrostatic document printer in which a cleaning blade of the invention is useful and is shown as being embodied.

Referring now to FIG. 1, a conventional electrophotographic document printer 100 is shown to include a primary image-forming member 103, for example, a rotatably driven conductive drum having an outer surface of a photoconductive material. One or more transferable toner images are formed on the photoconductive surface of drum 103 by first uniformly charging the surface with electrostatic charge provided by a corona charger 105, or the like. The uniformly charged surface is then imagewise exposed to actinic radiation provided, for example, by a laser scanner 106, thereby selectively discharging the charged surface and leaving behind a latent charge image. Finally, the latent charge image is rendered visible (developed) by applying electroscopic toner particles using a magnetic brush applicator 107, or the like. In some printers of this type, a series of toned process control patches (images) are also formed on the surface of the image-forming member, such patches being located in the interframe region between successive image frames.

The above-noted toner images and toned process control patches are then transferred to an intermediate image-transfer member 108 at a transfer nip 109. Any residual toner on the image-forming member 103 is removed by a cleaning brush 104 and/or a cleaning blade prior to recycling the image-forming member through the image-forming process. The image-transfer member 108 includes, for example, an electrically-conductive drum 141 having a compliant blanket 143 with a relatively hard overcoat 142. The conductive drum 141 is electrically biased by a power supply 150. The toner images transferred onto intermediate image-transfer member 108 are then re-transferred to an image-receiver sheet S at a second image-transfer nip 110 formed by a relatively small transfer roller 121 and an endless sheet-transport web 116 made of a dielectric material such as a polymer compound. Web 116 can include a release oil-absorbing porous layer comprising alumina particles in a binder as described in U.S. Pat. No. 7,120,380, US 2006/0165974, US 2007/0196151, US 2008/0107463 and US 2009/0052964 incorporated by reference above. The toner images are electrostatically attracted to the image-receiver sheets by a suitable electrical bias applied to transfer roller 121 by a power supply 152. Residual toner on member 108 is removed by a cleaning brush 111 and/or a cleaning blade.

The image-receiver sheets are presented to the endless sheet transport web 116 at a sheet-feed station 112. Web 116 is trained around a pair of rollers 113 and 114, and a motor M serves to drive roller 113 in the direction indicated by the arrow. Motor M also serves to rotatably drive the image-forming and image-transfer drums. The image-receiver sheets (e.g., paper or plastic) attach to web 116 at a corona charging station 124 which operates to charge the top surface of the sheet so that it becomes electrostatically attracted to the web 116. The rollers 113 and 114, which are grounded, serve to charge to the backside of the web 116. A corona charger 126 serves to detack the image-receiver sheets as they wrap around transport roller 114, thereby freeing the sheets for further transport to a toner fusing station, not shown. Note, being outside the image frame areas on the image-forming drum, any toned process-control patches transferred to the image-transfer member 108 will re-transfer directly to the transport web in the region between successive image-receiver sheets. These toned patches are intended to be removed from the web before receiving a new image-receiver sheet. Otherwise, the toner from these patches could transfer to the rear side of the image-receiver sheets. An electrophotographic document printer of the type shown in FIG. 1 is more thoroughly described in U.S. Pat. No. 6,075,965, the disclosure of which is incorporated herein by reference.

Web-cleaning apparatus 130 is provided for removing not only the random toner particles, dust, paper debris, and the like that can accumulate on the outer surface of the transport web 116 during repeated use of the printer described above, but also any relatively heavy deposits of toner that are transferred to the web, for example, as the result of forming the aforementioned process-control patches on the image-forming drum, paper jams, misregistration of a toner image to the image-receiver sheet, and the like. As indicated above, such toned patches (designated as TP in FIG. 2) are formed at predetermined locations on the image forming member in the interframe areas and are used, for example, to control registration of multiple color-separated images on the surface of a single image-receiver sheet and/or to monitor the effectiveness of the image-forming process across the width of the image-forming member. These patches get transferred to the web in the spaces between successive image-receiver sheets and are "read" on the web by a densitometer D located downstream of the second image-transfer nip 110. As will be appreciated, all particles on the sheet-bearing surface of web 116 should be removed or cleaned from the web before the web receives a new image-receiver sheet. The web-cleaning apparatus, generally designated as "130" is particularly well adapted to perform this duty and, as shown, is positioned downstream of a transport web conditioning charger 129 that acts to discharge the web surface to facilitate the cleaning function.

Figure 2:
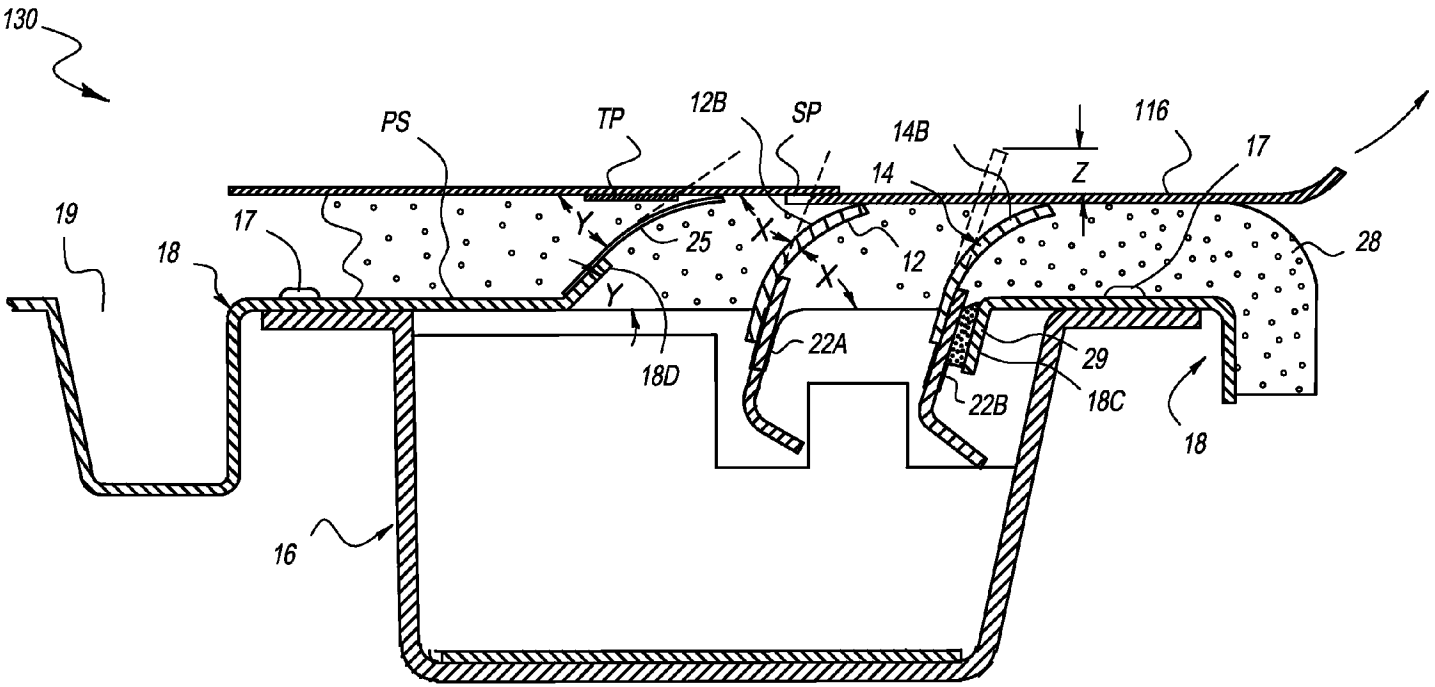
FIG. 2 is a cross-sectional illustration of a web-cleaning apparatus including a cleaning blade of the invention, such apparatus shown to be operating on the surface of a sheet-transport web as illustrated in the FIG. 1 printer.

Referring to FIG. 2, web-cleaning apparatus 130 is shown including a customer-replaceable cleaning cartridge including a pair of cleaning blades 12, 14 adapted to contact the outer surface of web 116 and to wipe particulate material there from; a sump housing 16 for releasably supporting the cleaning blades 12, 14 in a spaced parallel relationship and for receiving and storing particulate material removed or scavenged from the outer surface of web 116 by the cleaning blades 12, 14; and a multi-purpose lid assembly including lid member 18 attached to the top of the sump housing 16 that serves not only to prevent scavenged particles from escaping the edges of the sump housing 16, but also to both clean the edges of the web and collect particles deflected from the web by a seal blade (described below) at a location upstream of the cleaning blades 12, 14.

Figure 3C:
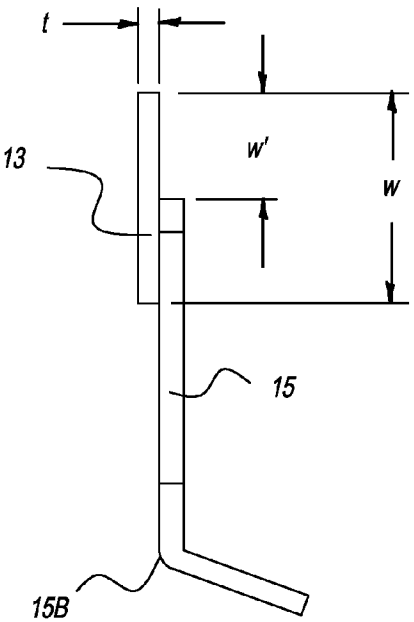
FIGS. 3A, 3B, and 3C are perspective, front, and side elevations of a cleaning blade.
Figure 3A:
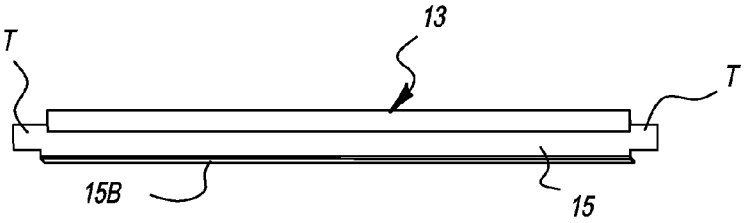
Figure 3B:
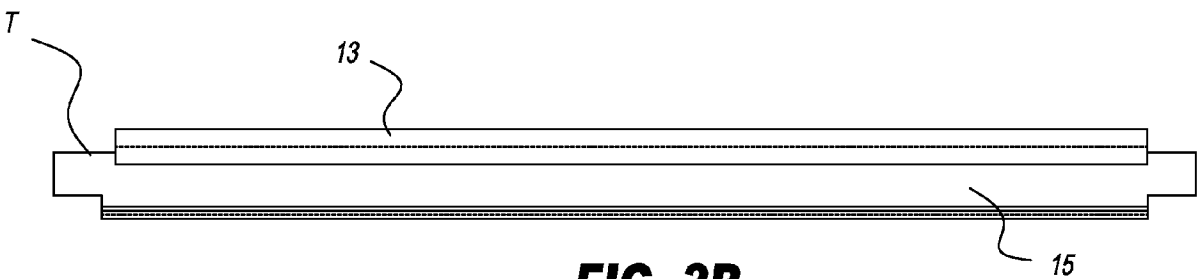

Referring to FIGS. 3A-3C, each of the cleaning blades 12, 14 comprises a flexible blade element 13 and a rigid stiffening plate 15. The flexible blade element 13 preferably comprises a rectangular slab of polyester polyurethane with the following properties: a hardness of between 60 and 85 Shore A, an initial modulus of between 500 and 1500 psi, a Bayshore resiliency above 30%, and a compression set lower than 25%. The polyurethane slab is fabricated with a thickness t of about 0.050" and a width w of 0.500". The length of the flexible blade elements 13 can be equal to the width of web 116. Preferably, the blades extend about 12 mm to about 25 mm beyond each of the edges of the widest image-receiver sheet size but within the web width. The polyurethane slab is glued to the stiffening plate 15, the latter preferably being made of steel, so as to produce a free extension w' of 0.250" (see FIG. 3C). In general, the ratio of the polyurethane thickness to the free extension should be between 0.125 to 0.250. As shown, the steel stiffener plate 15 is provided with a bend 15B along one edge thereof, thereby giving the plate a somewhat L-shaped cross-section. The purpose of the bend 15B is to reduce any bending tendency of the stiffening plate 15 along its length. The bend angle is preferably between 90 and 150 degrees, and it should be such as not to provide a barrier to particle flow into the sump housing 16. A pair of opposing extension tabs T is provided on each stiffening plate 15 for mounting the blades 12, 14 on the sump housing 16. Tabs T are designed so that they rest on the respective bottom surfaces of a pair of supporting notches formed in the sump housing side walls, as described below. When so seated, the cleaning blades 12, 14 are in a locked position relative to the direction of motion of the web 116. In accordance with the present invention, the flexible blade elements 13 are coated with a fluorinated polyurethane ceramer coating surface layer.

Sump housing 16 comprises a generally rectangular tray, preferably made of plastic and injection-molded, that defines a reservoir for receiving particulate material removed from the web 116. The tray has a pair of opposing side walls, each defining a pair of notches, i.e., notches 22A, 22B (FIG. 2). As indicated above, these notches are shaped to support the extension tabs T extending axially from the respective ends of the cleaning blades 12 and 14. The notches are so located and oriented in the side walls so as to support the two cleaning blades 12, 14 in a spaced, parallel relationship, with blade elements 12B and 14B being arranged at an acute angle X relative to the upper planar surface PS of a lid member 18 and to the oncoming web surface (i.e., the upstream portion of the web). Thus, the blade elements 12B, 14B will be supported in a "wiping" mode. The blades 12, 14 are installed by simply dropping the extension tabs T of the blades 12, 14 into the notches 22A, 22B of the sump housing 16. Thus, the blades are removed by simply lifting them out of their supporting notches. The blade-supporting notches are arranged so as to produce a predetermined and desired wiping angle and interference with the surface to be cleaned. Preferably, the wiping angle is between 60 and 85 degrees and, most preferably, about 80 degrees. The amount of blade interference Z with the web surface depends on the stiffness of the blade and the desired load to clean. In general, this interference can be between 0.010" to 0.100" and is, preferably, between 0.010" and 0.060", and a normal load is within the range of from 10 to 60 g/cm. It is contemplated that it may be desirable to set the first blade at a lower load so as to function primarily as the cleaner of the bulk of the toned patches and a trapper of lint, paper dust, and oil, and set the second blade at a higher load to complete the cleaning operation. This result can be achieved by making adjustments to the cleaning blades 12, 14 (e.g., by varying the thickness t, width w, or material of the flexible blade elements 12B, 14B) and/or by varying the depth of the blade-supporting notches in the sump housing 16. It is preferred that both blades 12, 14 be set at the same load. A preferred spacing between the two cleaning blades 12, 14 is between 0.250 and 0.750" to reduce any chance of toner spilling while allowing enough room for particles to flow down into the sump housing 16.

Lid member 18 cooperates with the sump housing 16 to provide a substantially enclosed chamber for particulate material scavenged from the web. Lid member 18 is preferably fabricated from a static dissipative plastic material; it can, however, alternatively be made of a light weight metal, such as aluminum. Preferably, the lid member 18 is designed to snap onto the top of the sump housing 16. Alternatively, it can be rigidly connected to the sump housing 16 by suitable fasteners 17.

Lid member 18 has a substantially planar surface PS in which a substantially rectangular opening is formed. Blade elements 12B and 14B of the cleaning blades 12, 14 project though the opening when the blades 12, 14 are seated in the sump housing 16. A flange 18C extends downwardly from the downstream edge of the opening and serves to provide backup support for a foam seal 29 located behind the second cleaning blade 14. Seal 29 operates to seal the downstream end of the cartridge from loss of scavenged particles through the opening. Seal 29 does not contact the moving web 116, and it should be separated from the web 116 by at least 0.075" to prevent possible toner recontamination due to slight build up of toner from the collisions of the blade elements 12B, 14B with a splice SP in web 116.

A second flange 18D extending upwardly from the upstream edge of the opening at an angle Y serves to support a thin, flexible seal blade 25 that projects upwardly from lid member 18, generally towards the first cleaning blade 12. In addition to sealing the upstream end of the cartridge from a loss of scavenged particles during use, seal blade 25 also acts to deflect particles wiped from the web by blade 12 toward and through the lid opening and ultimately into the underlying sump housing 16. The gap between the free edge of seal blade 25 and the first cleaning blade 12 is relatively narrow, preferably being between 0.150" and 0.750" in width to reduce any chance of scavenged particle spillage or leakage. Seal blade 25 is relatively thin (e.g., less than 0.004") and extends at a relatively shallow angle Y between 15 and 30 degrees relative to the web surface. At such an angle, the seal blade 25 has minimal effect on scavenging particulate material from the web 116. The seal blade dimensions are selected to reduce waviness in the blade edge. Several materials are preferred, including polyesters, nylon, polycarbonate, polyethylene, and the thickness of seal blade 25 is preferably less than 0.0025". The free extension of blade 25 (i.e., that part that extends beyond the edge of tab 18D) is preferably less than 1" to reduce waves but more than 0.100" to maintain a flexibility that prevents particle scavenging. The preferred range of free extension is between 0.300" and 0.600". Preferably, the forward end of lid member 18 is shaped to define an elongated cavity 19 that extends across the entire width of the lid and operates as an auxiliary external sump adapted to collect and contain any particulate material that is deflected from the web 116 upstream of the intended web-cleaning location (e.g., by seal blade 25).

Foam seal 28 is attached to lid member 18 at both sides of the sump housing 16. These seals serve both to reduce any leakage of scavenged particles out of the sides of the sump during use of the cartridge, and to wipe particles from the sides of the web 116. Each seal has an adhesive on the side facing the lid member 18 and a wear-resistant fabric, e.g., Nylon, on the side facing the web 116. These seals reduce any leakage of scavenged particles from the sides of the sump during use of the cleaning apparatus. The foam portion of the seal needs to be of high resiliency, low density, and a low compression set to maintain an effective seal and to reduce any drag torque on the transport web 116. A preferred foam material is R200/U polyester having a density of 2 lb. per cubic cm. The Tricot fabric also serves to reduce friction between the web surface and the seal 28, and it provides some cleaning of the web surface not covered by the blades 12, 14.

The cleaning blade preferably is made of polyurethane. Polyurethane is a versatile polymer known for its toughness and ability to be tailored to various degrees of hardness (Shore A). However, polyurethane has a high surface energy when compared to materials such as fluorinated hydrocarbon polymers like Teflon™, and various silicones. This surface energy characteristic makes the release of particles such as toner or other contaminants difficult.

Fluorinated coatings described in prior art tend to be soft and wear off easily. Fluorinated polyurethane ceramer coatings as employed in the present invention are advantaged compared to these coatings because it combines the low surface energy characteristic from a fluorinated moiety (e.g., a fluorinated polyol) incorporated into the polyurethane with the durability imparted by the inorganic phase of the ceramer. Also the need for a primer layer is eliminated due to the compatibility of the polyurethane blade substrate with the ceramer overcoat.

The fluorinated polyurethane ceramer coating preferably comprises the reaction product of a fluorinated polyurethane having terminal reactive alkoxysilane moieties with a tetraalkoxysilane compound, and can be prepared by incorporating fluorinated ethers into the polyurethane backbone before it is end-capped with the isocyanatopropyltrialkoxysilane in the preparation of a polyurethane silicate hybrid organic-inorganic network as described in U.S. Pat. No. 5,968,656 (as illustrated in Scheme 1 below). In such embodiment, the polyurethane with terminal alkoxysilane groups is the reaction product of one or more aliphatic polyols having terminal hydroxyl groups, at least one comprising a fluorinated polyol as further discussed below, and an alkoxysilane-substituted alkyl isocyanate compound. Suitable aliphatic polyols typically have molecular weights of about 60 to 8000 and can be polymeric. Polymeric aliphatic polyols can further include a plurality of functional moieties selected from the group consisting of an ester, an ether, a urethane, a non-terminal hydroxyl, and combinations thereof. Polymeric polyols containing ether functions are preferably polytetramethylene glycols having number-average molecular weights from about 200 to 6500, which can be obtained from various commercial sources. For example, Terathane™-2900, -2000, -1000, and -650 polytetramethylene glycols having the indicated number-average molecular weights are available from DuPont.

Polymeric polyols containing a plurality of urethane and ether groups can be obtained by reaction of fluorinated polyols and non-fluorinated polyols (such as polyethylene glycols) with alkylene diisocyanate compounds containing about 4 to 16 aliphatic carbon atoms, for example, 1,4-diisocyanatobutane, 1,6-diisocyanatohexane, 1,12-diisocyanatododecane, and, preferably, isophorone diisocyanate (5-isocyanato-1-(isocyanatomethyl)-1,3,3-trimethylcyclohexane). The reaction mixture can further include monomeric diols and triols containing 3 to about 16 carbon atoms; the triol compounds provide non-terminal hydroxyl substituents that provide branching of the polyurethane. In a preferred embodiment of the invention, a polymeric polyol is formed from a mixture of isophorone diisocyanate, a polytetramethylene glycol having a number-average molecular weight of about 650, a fluoroalkoxy substituted polyether polyol having a number-average molecular weight of about 6300, 1,4-butanediol, and trimethylolpropane in a molar ratio of about 9:3:0.1:5:1.

Reaction of the aliphatic, preferably polymeric, polyol having terminal hydroxyl groups with an alkoxysilane-substituted alkyl isocyanate compound, which can be promoted by a condensation catalyst, for example, an organotin compound such as dibutyltin dilaurate, provides a polyurethane having terminal reactive alkoxysilane moieties, which undergoes further reaction, preferably acid-catalyzed, with a tetraalkoxysilane compound to provide a ceramer useful for the surface layer of the cleaning blade of the present invention. The molar ratio of aliphatic polyol:alkoxysilane-substituted alkyl isocyanate is preferably about 4:1 to about 1:4, more preferably about 2:1 to about 1:2.

Aliphatic hydroxyl-terminated polyols employed in the preparation of the ceramer of the invention can be of the general formula $$HO—R^1—OH$$

and can have molecular weights of about 60 to 8000. As previously noted, at least one polyol is preferably polymeric, and $R^1$ can include a plurality of ester, ether, urethane, and non-terminal hydroxyl groups.

The alkoxysilane-substituted alkyl isocyanate compound preferably has the formula $$OCN—R^2—Si(OR^3)Z^1Z^2$$

where $R^2$ is an alkylene group containing about 2 to 8 carbon atoms, $OR^3$ is an alkoxy group containing 1 to about 6 carbon atoms, and $Z^1$ and $Z^2$ are moieties independently selected from the group consisting of alkoxy containing 1 to about 6 carbon atoms, hydrogen, halo, and hydroxy. More preferably, $R^2$ contains 2 to about 4 carbon atoms, and $OR^3$, $Z^1$, and $Z^2$ are each alkoxy groups containing 1 to about 4 carbon atoms. An especially preferred alkoxysilane-substituted alkyl isocyanate compound is 3-isocyanatopropyl-triethoxysilane.

The tetraalkoxysilane compound is preferably selected from the group consisting of tetramethyl orthosilicate, tetrabutyl orthosilicate, tetrapropyl orthosilicate, and, more preferably, tetraethyl orthosilicate.

The hybrid organic-inorganic network of the ceramer comprising the outer surface layer of the cleaning blade member of the invention has the general structure as illustrated in column 5 of U.S. Pat. No. 5,968,656, where $R^1$ and $R^2$ are as previously defined, with the proviso that at least a portion of the $R^1$ groups include a fluorinated moiety. The hybrid organic-inorganic network includes about 10 to 80 weight percent, more preferably about 25 to 65 weight percent, and most preferably about 35 to 50 weight percent silicon oxide. The outer surface layer has a thickness of about 1μ to 20μ, preferably about 2μ to 12μ. Its measured storage modulus is about 0.10 GPa to 2.0 GPa, more preferably about 0.30 GPa to 1.75 GPa, and most preferably about 1.0 GPa to 1.5 GPa. The fluorinated moiety in such ceramer can be conveniently obtained wherein the aliphatic hydroxyl-terminated polyol (such as a polyether diol) employed in formation of a non-fluorinated ceramer is partially replaced with the fluorinated ether to incorporate the low surface energy component into the polymer backbone. Full replacement of the aliphatic hydroxyl-terminated polyol with the fluorinated diol is generally not desirable as the surface properties do not change a great deal after the fluoropolymer accounts for more than about 20 wt % of the end capped polymer, also known as the "masterbatch."

A number of fluoroethers are available commercially that are suitable for use in this invention. In general the dihydroxy terminated fluoroalcohols are preferred because they can be polymerized directly into the urethane polymer. The use of monohydroxyfluoroalcohols is not desirable because the end groups of the ceramer masterbatch should ideally contain trialkoxysilane functionality for subsequent reaction with the sol-gel precursors. The monomers should generally be dials or triols. The dihydroxyfluoroethers are described in a report from the Department of Energy DOE/BC/15108-1 (OSTI ID: 750873) Novel $CO_2$-Thickeners for Improved Mobility Control Quarterly Report Oct. 1, 1998-Dec. 31, 1998 by Robert M. Enick and Eric J. Beckman from the University of Pittsburgh and Andrew Hamilton of Yale University, published February 2000 (http://www.osti.gov/bridge/servlets/purl/750873-KDMj2Z/webviewable/750873.pdf). On page 4 of this report, the commercially available difunctional hydroxyl-terminated fluorinated polyether Ausimont Fluorolink D is described. The material has an average molecular weight of 2000 g/mol and a structure:

$$HOCH_2CF_2(R1)p(R2)qCF_2CH_2OH.$$

Also described is the commercially available difunctional isocyanate terminated fluorinated ether Ausimont Fluorolink B. This urethane precursor has an average molecular weight of 3000 g/mol and a structure:

$$OCN—Ar—OCCF_2O(R1)p(R2)qCF_2CONH—Ar—NCO.$$

In these structures, R1=$CF_2CF_2O$; R2=$CF_2O$, and Ar=an aromatic group. In both fluorinated macromonomers, the difunctional contents are greater than 95% as characterized by NMR analysis. Ausimont describes both compounds as polydisperse.

Similar fluoroethers are also available from Aldrich Chemical, Milwaukee, Wis., USA, including multifunctional blocks. They are:

Poly(tetrafluoroethylene oxide-co-difluoromethylene oxide) α,ω-diol, $HOCH_2CF_2O(CF_2CF_2O)x(CF_2O)y CF_2CH_2OH$, average $M_n$≈3800;

Poly(tetrafluoroethylene oxide-co-difluoromethylene oxide) α,ω-diol bis(2,3-dihydroxypropyl ether), $HOCH_2CH(OH)CH_2OCH_2CF_2O(CF_2CF_2O)x(CF_2O)y CF_2CH_2OCH_2CH(OH)CH_2OH$, average $M_n$≈2000;

Poly(tetrafluoroethylene oxide-co-difluoromethylene oxide) α,ω-diol, ethoxylated $HO(CH_2CH_2O)_xCH_2CF_2O(CF_2CF_2O)_y(CF_2O)zCF_2CH_2(OCH2CH_2)_xOH$, average $M_n$≈3000.

Poly(tetrafluoroethylene oxide-co-difluoromethylene oxide) α,ω-diisocyanate, $CH_3C_6H_3(NCO)NHCO_2(CF_2CF_2O)_x(CF_2O)_yCONHC_6H_3(NCO)CH_3$, average $M_n$≈3000.

Also suitable are PolyFox™ Fluorochemicals from OMNOVA Solution INC., Fairlawn, Ohio, USA, of the following structures:

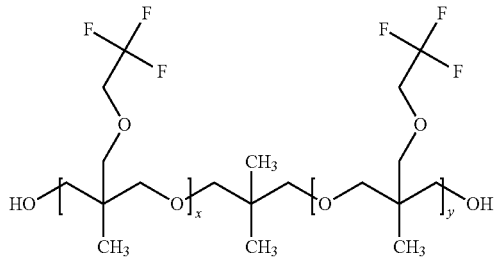

PolyFox PF-636 x + y = 6
PolyFox PF-6320 x + y = 20

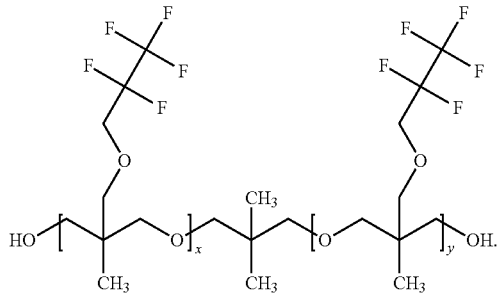

PolyFox PF-656 x + y = 6
PolyFox PF-6520 x + y = 20

The incorporation of the fluoromonomer can be represented as shown below in Scheme 1.

Scheme 1
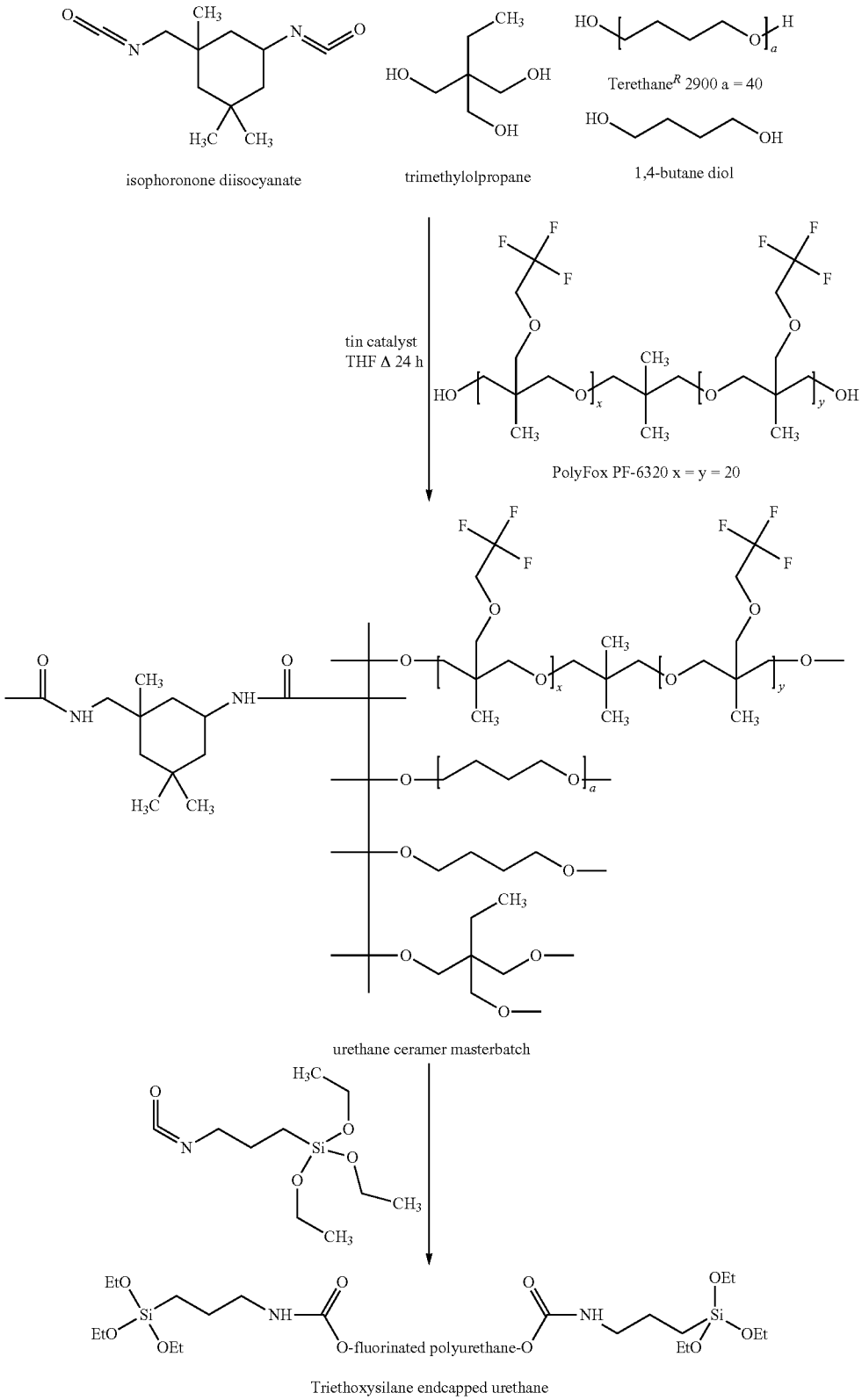
In the examples described below, the triethoxysilane endcapped fluorinated polyurethane was allowed to react with tetraethoxyorthosilicate (TEOS) in the presence of acid and water to hydrolyze and condense the siloxane into a silsesquioxane network. These materials were coated on nickellized PET and cured overnight at 80° C. to form a polyurethane silicate hybrid organic-inorganic network. Analysis by toner particle adhesion was carried out by measuring the force required to remove the toner from the substrate. In this way the release properties of ceramer, fluoroceramer and nickel-coated PET can be compared (see Examples).

A very light coating of toner particles was deposited on the substrate using a sumpless magnetic brush biased at approximately −10 V. This potential was found to deposit a sufficient number of negatively charged toner particles to permit effective statistical counting, but still left the particles generally isolated from each other. To ensure that the toner deposition and resulting adhesion were not influenced by a triboelectric interaction between the toner particles and the polycarbonate, the discharged substrate was developed in a normal manner with the exception that the brush was also grounded. In addition, the development system was set up so the flow of the developer was matched to the speed of the sample. This was accomplished by adjusting the magnetic brush shell speed to counter the core speed until there was zero net flow of developer, and then adjusting the shell speed so that the speed of the developer matched that of the substrate. A small deposit of toner was developed, resulting in a post-development potential of approximately −5 V. When this toner was removed using canned air, the substrate potential was again 0 V, indicating that no observable tribocharging had occurred and that the observed potential arose simply from the charge of the adhering toner particles.

The detachment force was determined using a Beckman L8070M ultracentrifuge capable of speeds up to 70,000 rpm. At 70,000 rpm the acceleration of the centrifuge with the 6.45 cm radius rotor is 354,000 g. The number of particles on a sample of the substrate was determined by counting the particles in five areas under a microscope using Image-Pro particle-counting software. The sample was then placed in the rotor and spun at the desired speed. The sample was then removed and the number of residual particles was then determined in a similar manner. In order to eliminate the possibility of increases in adhesion caused by the occurrence of plastic deformations or from the rotation of the particles on the substrate following deposition, all measurements were made on the same day as the deposition. Moreover, the centrifuge speeds were randomized to ensure that any systematic deviation would be observed. The applied force needed to remove 50% of the particles initially on the substrate was considered to be the detachment force.

Trialkoxyfluorosilanes can also be used to introduce fluorinated alkyl groups into the ceramer. The carbon-silicon bond is stable in both acid and base. These bonds are unlike the hydrolysable silicon-oxygen of the silicon alkoxides, which cleave and form the condensation products of the ceramer. Thus, in the same way the end capped fluorourethane will be incorporated into the ceramer product, so to will fluoroalkyl moiety that is part of a alkyltrialkoxysilane. Many are available commercially including nonafluorohexyltriethoxysilane [chemical abstract services (CAS) number 102390-98-7], nonafluorohexyltrimethoxysilane [85877-79-8], (heptadecafluoro-1,1,2,2-tetrahydrodecyl)triethoxysilane [101947-16-4], (heptadecafluoro-1,1,2,2-tetrahydrodecyl) trimethoxysilane [83048-65-1. Additionally more reactive groups can be used in place of the alkoxy groups. For example both chloro and amino groups will hydrolyze from the silicon atom in the presence of alcohol or water. An example of the fluoroalkylsilane with hydrolysable chloro functionality would be (heptadecafluoro-1,1,2,2-tetrahydrodecyl)trichlorosilane [78560-44-8]. The condensation of trihydroxy-substituted silicon atoms that contain an alkyl group are known as silsesquioxanes, and are sometimes represented by the formula $RSiO_{1.5}$, which would describe the product of the derivatized fluorinated urethane if the TEOS was replaced with the trialkoxysilane. Mixing of the TEOS with the fluorinated trialkoxysilane would produce a material somewhere between a silsesquioxane and a ceramer. Additionally, a certain level of di or monohydrolysable fluoroalkylsilane can be used to incorporate fluorinated groups into the ceramer. These would include heneicosafluorododecyltrichlorosilane [102488-49-3] and (heptadecafluoro-1,1,2,2-tetrahydrodecyl)methyldichlorosilane [3102-79-2].

Surface Roughness of Belts to be Cleaned.

Endless webs or belts used in electrophotographic printers are often made of PET. Belts are often made by joining the ends of the flexible plastic and sealing them together by heat, ultrasonic welding, or adhesives. Gamma-alumina is disclosed as an oil absorbing layer that employs fluoro surfactants as cleaning aids in US 2009/0052964. Table 1 shows the surface roughness in nanometers of a sheet of PET, which is 1.49 nm by atomic force microscopy (AFM). Coatings of transport webs with alumina particles in a binder absorb fuser oil and protect the surface of the image receiver from oil contamination. The surface roughness of the alumina coated PET is 32.76 nm, approximately an order of magnitude rougher than the uncoated PET web. An uncoated urethane cleaning blade that did not have a high modulus ceramer coating was more quickly damaged by the rough alumina surface than by the smooth PET surface. However the urethane blade coated with the ceramer was more resistant to damage by the rough alumina coating than the uncoated blade.

TABLE 1

Surface Roughness of PET and Alumina Coated PET by AFM

| Sample Identification | Micro Surface Roughness RMS (nm) | Standard Deviation | Peak-to-Valley Measurements (nm) | Standard Deviation |
|---|---|---|---|---|
| PET Reference | 1.49 | 0.07 | — | — |
| Alumina coated PET | 32.76 | 1.14 | 278.52 | 33.68 |

The samples were examined using Tapping Mode AFM at a 10-micron and a 2-micron scan size for surface morphology characterization and surface roughness measurements. Micro surface roughness calculations were taken from the 10-micron scan size.

The difference in the roughness of the alumina coating compared to the uncoated PET is also evident by optical microscopy (Table 2). The Vertical Scanning Mode of a WYKO optical system was used to examine sample sizes of 1 square centimeter of coating. As with the AFM measurements, the coated sample by optical microscopy is an order of magnitude rougher than the uncoated sample. Polyurethane cleaning blades that effectively clean the uncoated PET sample are not as effective for cleaning the alumina coated samples.

TABLE 2

Surface Roughness of PET and Alumina Coated PET by Optical Microscopy.

| Sample Id. | Ra(nm) | Std. | Rq(nm) | Std. | Rt(um) | Std. |
|---|---|---|---|---|---|---|
| PET (unsubbed) | 9.42 | 0.91 | 16.39 | 2.63 | 1.55 | 0.94 |
| Alumina Coating | 86.94 | 0.95 | 111.38 | 2.16 | 2.64 | 1.01 |

Ra(Roughness Average): The arithmetic average height calculated over the entire measured array.
Rq(Root Mean Square Roughness): The root mean square average height calculated over the entire measured array.
Rt(Maximum Profile Height): The distance between the highest and lowest points over the evaluation length.

Samples for surface roughness evaluation were prepared for examination by gold coating with a Denton DV502 vacuum evaporator. The samples were examined with the 10× objective at 0.5 for in the VSI mode. Five fields of each sample were examined and the statistics of the five fields were averaged.

EXAMPLES

Preparation of Fluorinated and Non-fluorinated Ceramer Solutions 10 wt % Fluorinated Masterbatch. To a 500 mL, three-neck round bottom flask containing dry tetrahydrofuran (THF) (150 mL) under nitrogen was added Terathane™ 650 polytetramethylene glycol (19.45 g, 0.030 mol), 1,4-butanediol (4.25 g, 0.047 mol), Polyfox™ PF-6320 (5.36 g, 0.0014 mol) and trimethylolpropane (1.30 g, 0.010 mol). The mixture was stirred under nitrogen until a solution was obtained; then isophorone diisocyanate (19.64 g, 0.088 mol) was added, and then the mixture was degassed under reduced pressure (0.1 mm Hg). Dibutyltin dilaurate (0.10 g, 0.0002 mol) was added, and the mixture was heated at 60° C. under nitrogen for 5 hours. To the above solution was added 3-isocyanatopropyltriethoxysilane (4.04 g, 0.0081 mol) and additional THF (35 mL). The mixture was heated at 60° C. for 15 hours, yielding a solution containing 24 wt % dissolved solids.

Example 1

10 wt % Fluorinated Ceramer with 1.47 TEOS/polymer

To 50 g of the above 10 wt % Fluorinated Masterbatch solution in a 500 mL plastic beaker was added isopropanol (18 mL) and tetraethyl orthosilicate (TEOS) (17.7 g, 0.085 mol). The solution was stirred at room temperature for several minutes, followed by the addition of 0.15 N hydrochloric acid (6.84 mL). The solution was stirred at room temperature for 48 hours, after which Silwet™ L-7002 (0.18 g) was added. The resulting solution was stirred for 15 minutes longer before coating or casting.

Example 2

10 wt % Fluorinated Ceramer with 1.75 TEOS/polymer

To 50 g of the above 10 wt % Fluorinated Masterbatch solution in a 500 mL plastic beaker was added isopropanol (21 mL) and TEOS (20.95 g, 0.101 mol). The solution was stirred at room temperature for several minutes, followed by the addition of 0.15 N hydrochloric acid (8.09 mL). The solution was stirred at room temperature for 48 hours, after which Silwet™ L-7002 (0.18 g) was added. The resulting solution was stirred for 15 minutes longer before coating or casting.

5 wt % Fluorinated Masterbatch. To a 500 mL, three-neck round bottom flask containing dry tetrahydrofuran (THF) (150 mL) under nitrogen was added Terathane™ 650 polytetramethylene glycol (20.62 g, 0.032 mol), 1,4-butanediol (4.50 g, 0.050 mol), Polyfox™ PF-6320 (2.84 g, 0.0008 mol) and trimethylolpropane (1.38 g, 0.010 mol). The mixture was stirred under nitrogen until a solution was obtained; then isophorone diisocyanate (20.66 g, 0.093 mol) was added, and then the mixture was degassed under reduced pressure (0.1 mm Hg). Dibutyltin dilaurate (0.10 g, 0.0002 mol) was added, and the mixture was heated at 60° C. under nitrogen for 5 hours. To the above solution was added 3-isocyanatopropyltriethoxysilane (2.11 g, 0.0085 mol) and additional THF (35 mL). The mixture was heated at 60° C. for 15 hours, yielding a solution containing 24 wt % dissolved solids.

Example 3

5 wt % Fluorinated Ceramer with 1.47 TEOS/polymer

To 35 g of the above 5 wt % Fluorinated Masterbatch solution in a 500 mL plastic beaker was added isopropanol (12 mL) and TEOS (12.36 g, 0.059 mol). The solution was stirred at room temperature for several minutes, followed by the addition of 0.15 N hydrochloric acid (4.79 mL). The solution was stirred at room temperature for 48 hours, after which Silwet™ L-7002 (0.124 g) was added. The resulting solution was stirred for 15 minutes longer before coating or casting.

Example 4

5 wt % Fluorinated Ceramer with 1.75 TEOS/polymer

To 35 g of the above 5 wt % Fluorinated Masterbatch solution in a 500 mL plastic beaker was added isopropanol (15 mL) and TEOS (14.69 g, 0.071 mol). The solution was stirred at room temperature for several minutes, followed by the addition of 0.15 N hydrochloric acid (4.79 mL). The solution was stirred at room temperature for 48 hours, after which Silwet™ L-7002 (0.124 g) was added. The resulting solution was stirred for 15 minutes longer before coating or casting.

Non-Fluorinated Masterbatch. To a one liter, three-neck round bottom flask containing dry tetrahydrofuran (THF) (300 mL) under nitrogen was added Terathane™ 2900 polytetramethylene glycol (79.13 g, 0.027 mol), 1,4-butanediol (3.97 g, 0.044 mol), and trimethylolpropane (1.21 g, 0.0090 mol). The mixture was stirred under nitrogen until a solution was obtained; then isophorone diisocyanate (15.69 g, 0.071 mol) was added, and then the mixture was degassed under reduced pressure (0.1 mm Hg). Dibutyltin dilaurate (0.20 g, 0.0003 mol) was added, and the mixture was heated at 60° C. under nitrogen for 5 hours. To the above solution was added 3-isocyanatopropyltriethoxysilane (7.98 g, 0.033 mol) and additional THF (85 mL). The mixture was heated at 60° C. for 15 hours, yielding a solution containing 24 wt % dissolved solids.

Comparative Example 1

Ceramer with 1.50 TEOS/polymer

To 65 g of the above Ceramer Masterbatch solution in a 500 mL plastic beaker was added isopropanol (23 mL) and TEOS (23.40 g, 0.112 mol). The solution was stirred at room temperature for several minutes, followed by the addition of 0.15 N hydrochloric acid (9.19 mL). The solution was stirred at room temperature for 48 hours, after which Silwet™ L-7002 (0.23 g) was added. The resulting solution was stirred for 15 minutes longer before coating or casting.

Comparative Example 2

Ceramer with 1.87 TEOS/Polymer

To 15 g of the above Ceramer Masterbatch solution in a 100 mL plastic beaker was added isopropanol (7 mL) and TEOS (6.73 g, 0.032 mol). The solution was stirred at room temperature for several minutes, followed by the addition of 0.15 N hydrochloric acid (2.63 mL). The solution was stirred at room temperature for 48 hours, after which Silwet™ L-7002 (0.059 g) was added. The resulting solution was stirred for 15 minutes longer before coating or casting.

Comparative Example 3

Ceramer with 2.33 TEOS/polymer

To 15 g of the above Ceramer Masterbatch solution in a 100 mL plastic beaker was added isopropanol (8 mL) and TEOS (8.39 g, 0.040 mol). The solution was stirred at room temperature for several minutes, followed by the addition of 0.15 N hydrochloric acid (3.26 mL). The solution was stirred at room temperature for 48 hours, after which Silwet™ L-7002 (0.066 g) was added. The resulting solution was stirred for 15 minutes longer before coating or casting.

Comparative Example 4

Ceramer with 2.70 TEOS/polymer

To 65 g of the above Ceramer Masterbatch solution in a 500 mL plastic beaker was added isopropanol (42 mL) and TEOS (42.12 g, 0.20 mol). The solution was stirred at room temperature for several minutes, followed by the addition of 0.15 N hydrochloric acid (16.32 mL). The solution was stirred at room temperature for 48 hours, after which Silwet™ L-7002 (0.31 g) was added. The resulting solution was stirred for 15 minutes longer before coating or casting.

Comparative Example 5

Ceramer with 1.87 TEOS/polymer

To 60 g of the above Ceramer Masterbatch solution in a 500 mL plastic beaker was added isopropanol (27 mL) and TEOS (26.89 g, 0.13 mol). The solution was stirred at room temperature for several minutes, followed by the addition of 0.15 N hydrochloric acid (10.5 mL). The solution was stirred at room temperature for 48 hours, after which Silwet™ L-7002 (0.24 g) was added. The resulting solution was stirred for 15 minutes longer before coating or casting.

Comparative Example 6

Metallized PET with Nickel

Analysis of Fluorinated and Non-Fluorinated Ceramers

The above Examples and Comparative Examples of the fluorinated and non-fluorinated ceramers, respectively, were carried out using standard mechanical testing. Modulus and toughness were determined by casting samples into Teflon™ molds, allowing the solvent to evaporate and curing the samples at 80° C. The films were examined using an Instron™ mechanical tester and a TA Instruments dynamic mechanical analyzer. Knife coatings were prepared onto nickelized PET using an 8 mil knife. The coated films were cured at 80° C. for 24 hours. These coatings were used in the analysis of the surface energies determined by measuring the contact angles of water and diiodomethane. The toner detachment force was made using negatively charging toner as described above.

The detachment force as a function of the TEOS amount as well as the fluorinated urethane masterbatch are reported in Tables 3A and 3B. Initial TEOS/polymer weight ratios and TEOS wt % for the formulations are reported in Table 3A, and the inorganic content of the cured ceramers are reported in Table 3B as $SiO_2$ wt % as determined by subjecting coatings of the ceramers on Teflon to thermogravimetric analysis (TGA), which is described, in, for example, Campbell et al., *Polymer Characterization: Physical Techniques*, Chapman and Hall, New York, 1989, pp 317-318. It is observed that high amounts of TEOS correspond to lower applied forces necessary to detach the negatively charging toner particles from the ceramer substrate. For the TEOS series of Comparative Examples 1-4, this behavior is related to the ability of the toner particle to embed itself into the overcoat, which decreases with the increasing hardness E (Young Modulus) of the substrate (Table 3A). For the fluorinated ceramer, it appears that the low surface energy also plays a role on the detachment force since for similar Young Modulus (Comparative Example 4 and Example 2) the detachment force of the non-fluorinated sample is twice of what is observed for the low surface energy (fluorinated) sample. Only the metalized PET itself (Comparative Example 6) has a comparatively low detachment force to the fluorinated surface, probably because the modulus of the nickel metal is relatively large.

TABLE 3A

Mechanical Properties of Fluoroceramers and Ceramers

| Example | Masterbatch | TEOS/ polymer | TEOS initial, (wt %) | Young Modulus, E (MPa) | Toughness (MPa) |
|---|---|---|---|---|---|
| 1 | 10% fluoro | 1.47 | 59.5 | 809 | 0.35 |
| 2 | 10% fluoro | 1.75 | 63.6 | 1317 | 0.6 |
| 3 | 5% fluoro | 1.47 | 59.5 | — | — |
| 4 | 5% fluoro | 1.75 | 63.6 | — | — |
| Comp 1 | Std non-fluoro | 1.50 | 60 | 74 | 5.5 |
| Comp 2 | Std non-fluoro | 1.87 | 65.2 | 227 | 0.16 |
| Comp 3 | Std non-fluoro | 2.33 | 70 | 378 | 0.03 |
| Comp 4 | Std non-fluoro | 2.70 | 73 | 1395 | 0.03 |
| Comp 5 | Std non-fluoro | 1.87 | 65.2 | — | — |
| Comp 6 | NA | NA | NA | — | — |

TABLE 3B

Surface Energies, Level of Filler and Detachment Forces of Fluoroceramers and Ceramers

| Example | Surface Energy (erg/cm$^2$) | $SiO_2$ Wt % (TGA@ 800° C.) | Detachment Force (nN) (@ 50% toner removal) |
|---|---|---|---|
| 1 | 27.0 | 29.3 | 45 |
| 2 | 28.0 | 32.1 | 45 |
| 3 | — | — | ~270 |
| 4 | — | — | ~200 |
| Comp 1 | 34.6 | 30.7 | 373 |

TABLE 3B-continued

| Surface Energies, Level of Filler and Detachment Forces of Fluoroceramers and Ceramers | | | |
|---|---|---|---|
| Example | Surface Energy (erg/cm$^2$) | $SiO_2$ Wt % (TGA@ 800° C.) | Detachment Force (nN) (@ 50% toner removal) |
| Comp 2 | 33.6 | 35.1 | 205 |
| Comp 3 | 34.3 | 40.1 | 170 |
| Comp 4 | 32.6 | 42.7 | 90 |
| Comp 5 | 33.8 | — | ~360 |
| Comp 6 | >40 | NA | ~100 |

Figure 4:
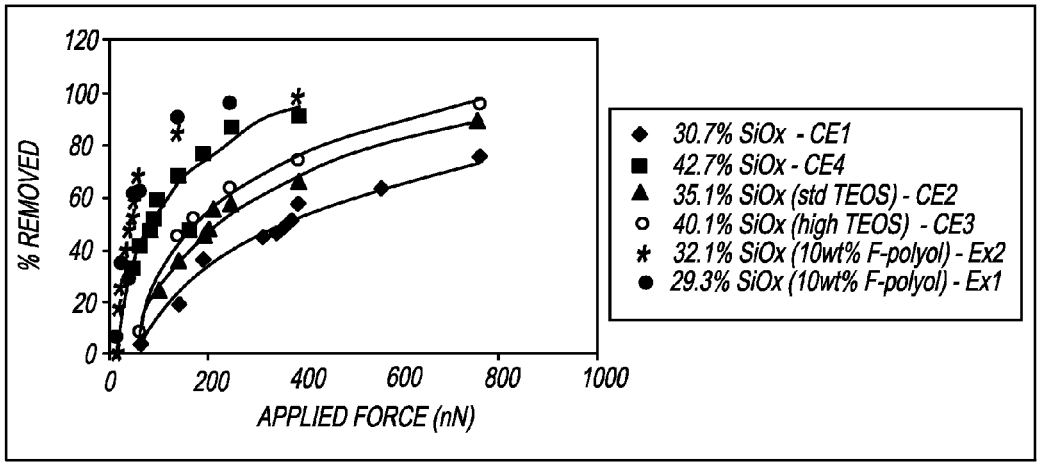
FIG. 4 is a graph illustrating the detachment force for toner from fluorinated and non-fluorinated ceramers as a function of the TEOS amount employed in the creamers.
Figure 5:
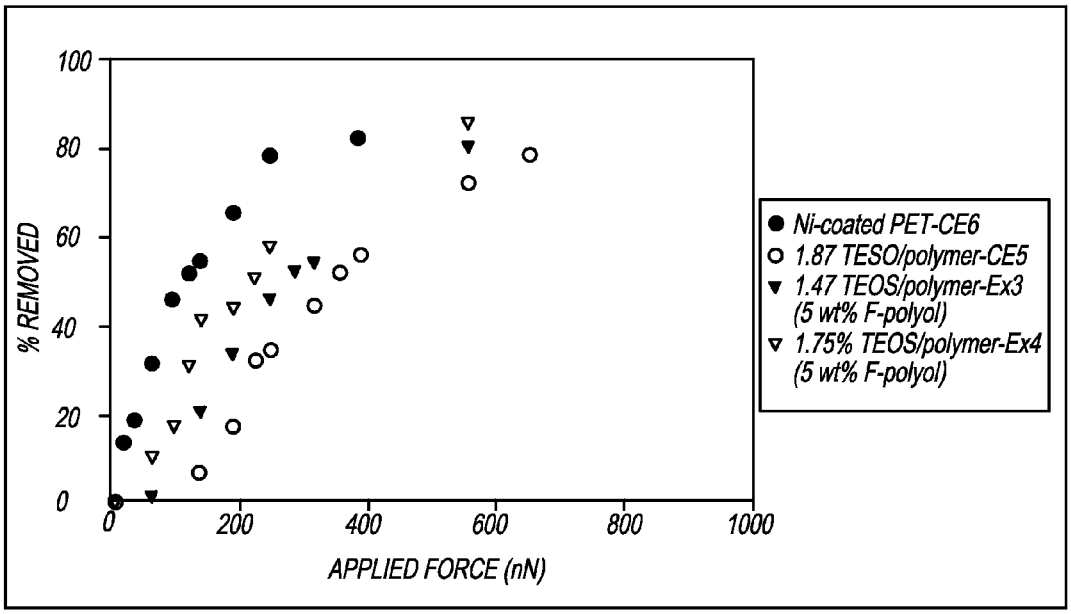
FIG. 5 is a graph illustrating the detachment force for toner from fluorinated and non-fluorinated ceramers as a function of the TEOS amount employed in the ceramers, as well as from nickelized PET without any ceramer coating.

The graphs for the Detachment Force are shown in FIGS. 4 and 5. As shown in FIG. 4, the toner is more readily removed from the non-fluorinated ceramer as the amount to TEOS is increased (Comparative Examples 1-4). The toner is most readily released from the 10% fluorinated urethane ceramer coatings, even though they have less filler and/or lower modulus. As shown in FIG. 5, negatively charging toner is more readily released from the 5% fluorinated urethane ceramer surfaces (Examples 3 and 4), even though the level of TEOS is lower than in the non-fluorinated ceramer (Comparative Example 5). Only the nickel metalized surface itself (Comparative Example 6) has lower detachment forces, where the modulus is expected to be very high.

Coating Polyurethane Blades with Fluorinated Ceramer.

Polyurethane blades have been used to remove toner from transport webs in NexPress™ Electrophotographic Printers. This cleaning system including the blades is described in U.S. Pat. No. 6,453,134, incorporated by reference herein. Two blades with the urethane of different thickness were used as substrates for coating with ceramer. A regular blade had a thickness of 0.05 inches and a stiffer blade had a thickness of 0.065 inches. The elastic modulus of the urethane used to fabricate the blades was between 750 and 1000 psi. The fluorinated ceramer coating was prepared as described in Example 1 above with 10% of the urethane comprising the fluorinated diol. The fluorinated ceramer was then diluted with an additional 25.2 g of isopropanol to give a solution of 7 wt % solids. The polyurethane cleaning blades were spray coated using a Preval™ lab sprayer. The coatings were cured by placing the blades in an oven and increasing the temperature to 80° C. over 1 hour and maintaining the temperature for 24 hours.

Polyurethane blades were coated with non-fluorinated ceramer in a similar manner.

Analysis of Ceramer Coated Blade. The fluoroceramer coating on the urethane blade was examined by optical microscopy. Microhardness measurements were carried out on a fluoroceramer coated blade and a urethane blade. The results are given in Table 4. The results show that the surface of the fluoroceramer coated blade has a higher modulus and is harder than the surface of the virgin urethane blade. The ceramer coating is approximately 4-5 um in thickness based on cross-section and WYKO evaluations. The ceramer coated wiper blade possessed a higher modulus and hardness than the uncoated wiper blade and displaced less. The ceramer coated wiper blade appeared to possess plastic properties based near surface and bulk system indentation properties. There was no apparent cracking or coating delamination present during this initial evaluation at the conditions tested, indicating that the coating was successful in a single step and a primer layer was not needed.

TABLE 4

| Near Surface Properties Comparing Coated and Uncoated Urethane Blades | | | |
|---|---|---|---|
| | Modulus-Near Surface Properties[1] (GPa) | Hardness-Near Surface Properities[2] (GPa) | Coefficient of Friction[3] |
| Fluoroceramer Coated Blade | 0.76 | 0.09 | 0.24; 0.28 |
| Regular Urethane Blade | 0.23 | 0.07 | 0.54; 0.4 |
| Ceramer Coated Blade | — | — | 0.35; 0.37 |

[1,2]MTS XP Indenter DCM 0.02 mN load, Berkovich tip

[3]Coefficient of Friction: CSEM, 10 mN load Constant nanoscratch, 3 mil(25 um) 90 deg spherical diamond stylus Coefficient of Friction results in Table 4 also show that the fluorinated ceramer has a lower coefficient of friction than both the non-fluorinated ceramer and the uncoated urethane blade. This low surface energy and the higher modulus for similar TEOS/polymer ratios combine to make the fluorinated ceramer coatings on the urethane blades superior for cleaning of rough web surfaces.

Cleaning Performance of Uncoated and Coated Blades. The urethane blades used to clean the PET webs are described in U.S. Pat. No. 6,453,134. Two blades are placed in a cleaning assembly one behind the other and the blades placed against the web to remove the toner as the web moves past the blades. The toner is in the form of three sets of five patches. Each patch is a separate color of cyan, magenta, yellow, black, and a fifth color. As shown in Table 5, the two regular blades that are used in cleaning of the PET web are unable to remove the toner from the alumina-coated web, leaving large patches regardless of whether the web is discharged before cleaning. This is shown as Comparative Example 7, that results in poor cleaning with the chargers on or off. Replacing the first blade with a stiffer urethane blade improves the cleaning of the web. Comparative Example 8 shows good cleaning was obtained when the web was discharged before cleaning, but not when the web was not discharged prior to cleaning. All five colors remained on the web under this condition.

Replacing the two regular urethane blades in Comparative Example 7 with two fluoroceramer-coated blades resulted in effective cleaning under both conditions. Example 5 shows all the toner was removed from the web when discharged prior to cleaning. Almost all of the toner was removed under the more stringent test conditions of not discharging the web, but a very small streak of magenta toner remained in the last frame. Example 6 employed a fluoroceramer-coated stiff urethane blade in the first position and a fluoroceramer-coated regular urethane blade in the second position. Example 6 showed complete removal of toner under all conditions.

TABLE 5

| Cleaning of Pre-Print Calibration Patches on Alumina Coated Web | | | | |
|---|---|---|---|---|
| Example | First Blade | Second Blade | Charger On | Charger Off |
| Comparative 7 | regular | regular | Poor | Poor |
| Comparative 8 | stiff | regular | Good | Poor |
| Example 5 | Coated regular | Coated regular | Good | *Good |
| Example 6 | Coated stiff | Coated regular | Good | Good |

*very small streak of magenta toner remained in the last frame.

Scanning electron micrographs were obtained of the ceramer coated blades after running for 1,000 prints against the alumina coated web. The ceramer coating was removed at the point of contact with the web to expose the urethane. The rest of the ceramer remained intact on the blade surface with no evidenc e of cracking or delamination.

The invention has been described in detail with particular reference to certain preferred embodiments thereof, but it will be understood that variations and modifications can be effected within the spirit and scope of the invention.

The invention claimed is:

1. A cleaning blade member comprising a polymer substrate and a fluorinated polyurethane ceramer coating surface layer.

2. The cleaning blade member according to claim 1, wherein the fluorinated polyurethane ceramer coating comprises a fluorinated polyurethane silicate hybrid organic-inorganic network formed as a reaction product of a fluorinated polyurethane having terminal reactive alkoxysilane groups with a tetraalkoxysilane compound.

3. The cleaning blade member according to claim 2, wherein the fluorinated polyurethane having terminal alkoxysilane groups comprises the reaction product of one or more fluorinated aliphatic polyols having terminal hydroxyl groups, one or more non-fluorinated aliphatic polyols having terminal hydroxyl groups, and an alkoxysilane-substituted alkyl isocyanate compound.

4. The cleaning blade member according to claim 3, wherein the fluorinated and non-fluorinated aliphatic polyols have molecular weights of about 60 to 8000.

5. The cleaning blade member according to claim 3, wherein at least one of the fluorinated and non-fluorinated aliphatic polyols is a polymer.

6. The cleaning blade member according to claim 3, wherein the alkoxysilane-substituted alkyl isocyanate compound has the formula $OCN—R^2—Si(OR^3)Z^1 Z^2$ wherein $R^2$ is an alkylene group containing 2 to about 8 carbon atoms, $OR^3$ is an alkoxy group containing 1 to about 6 carbon atoms, and $Z^1$ and $Z^2$ are moieties independently selected from the group consisting of alkoxy containing 1 to about 6 carbon atoms, hydrogen, halo, and hydroxyl.

7. The cleaning blade member according to claim 6, wherein $R^2$ is an alkylene group containing 2 to about 4 carbon atoms, and $OR^3$, $Z^1$, and $Z^2$ are each alkoxy groups containing 1 to about 4 carbon atoms.

8. The cleaning blade member according to claim 7, wherein the tetraalkoxysilane compound is selected from the group consisting of tetramethyl orthosilicate, tetraethyl orthosilicate, tetrapropyl orthosilicate, and tetrabutyl orthosilicate.

9. The cleaning blade member according to claim 8, wherein the alkoxysilane-substituted alkyl isocyanate compound is 3-isocyanatopropyl-triethoxysilane and said tetraalkoxysilane compound is tetraethyl orthosilicate.

10. The cleaning blade member according to claim 1, wherein the ceramer has a silicon oxide network comprising about 10 to 80 weight percent of the ceramer.

11. The cleaning blade member according to claim 1, wherein the surface layer has a thickness of about 1μ to 20μ.

12. The cleaning blade member according to claim 1, wherein the polymer substrate comprises polyurethane.

13. The cleaning blade member according to claim 1, wherein the fluorinated polyurethane ceramer coating is coated on the polymer substrate without any primer layer therebetween.

14. An electrostatographic apparatus comprising a toner-contacting member and a cleaning blade for the toner-contacting member, wherein the cleaning blade comprises a polymer substrate and a ceramer coating surface layer.

15. The apparatus according to claim 14, wherein the toner-contacting member comprises an endless transport web.

16. The apparatus according to claim 15, wherein the endless transport web comprises an alumina coated endless transport web.

* * * * *